US008387658B2

(12) United States Patent
Markefka

(10) Patent No.: US 8,387,658 B2
(45) Date of Patent: Mar. 5, 2013

(54) DELIVERY UNIT AND JET SUCTION PUMP

(75) Inventor: Klaus Markefka, Florstadt (DE)

(73) Assignee: Continental Automotive GmbH, Hannover (DE)

( * ) Notice: Subject to any disclaimer, the term of this patent is extended or adjusted under 35 U.S.C. 154(b) by 930 days.

(21) Appl. No.: 11/908,735

(22) PCT Filed: Jan. 11, 2006

(86) PCT No.: PCT/EP2006/050154

§ 371 (c)(1),
(2), (4) Date: Sep. 14, 2007

(87) PCT Pub. No.: WO2006/100130

PCT Pub. Date: Sep. 28, 2006

(65) Prior Publication Data

US 2008/0190495 A1 Aug. 14, 2008

(30) Foreign Application Priority Data

Mar. 24, 2005 (DE) ..... 10 2005 014 287

(51) Int. Cl.
*F04F 5/10* (2006.01)
*F02M 37/04* (2006.01)
*F02M 37/12* (2006.01)

(52) U.S. Cl. ..... 137/565.22; 137/574; 417/76; 417/79; 417/198; 123/509

(58) Field of Classification Search ..... 417/76, 417/79, 198; 137/565.22, 574; 123/509
See application file for complete search history.

(56) References Cited

U.S. PATENT DOCUMENTS

| | | | | |
|---|---|---|---|---|
| 3,394,655 | A | 7/1968 | Brown | |
| 4,886,031 | A | 12/1989 | Scheurenbrand et al. | 123/516 |
| 5,024,583 | A | 6/1991 | Sasaki et al. | 417/198 |
| 6,123,511 | A | 9/2000 | Sertier | 417/87 |
| 6,155,793 | A | 12/2000 | Tuckey et al. | 417/87 |
| 6,155,796 | A | 12/2000 | Schmalz et al. | 417/187 |
| 6,296,454 | B1 | 10/2001 | Schmid et al. | 417/151 |
| 6,457,945 | B2 | 10/2002 | Kleppner et al. | 417/84 |
| 6,685,439 | B1 | 2/2004 | Harrell et al. | 417/151 |
| 7,066,153 | B2 * | 6/2006 | Vitalis et al. | 123/514 |
| 2002/0031431 | A1 | 3/2002 | Akiyama et al. | 417/198 |
| 2004/0177886 | A1 * | 9/2004 | Nagata et al. | 137/571 |
| 2005/0241621 | A1 * | 11/2005 | Kieninger et al. | 123/509 |
| 2007/0104589 | A1 | 5/2007 | Marx | 417/87 |

FOREIGN PATENT DOCUMENTS

| | | |
|---|---|---|
| DE | 1028283 | 4/1958 |
| DE | 4336060 A1 | 4/1995 |
| DE | 19805072 A1 | 8/1999 |
| DE | 19856298 C1 | 2/2000 |

(Continued)

OTHER PUBLICATIONS

Chinese Office Action for Application No. 200680009230.8 (7 pages), Mar. 27, 2009.

*Primary Examiner* — Craig Schneider
*Assistant Examiner* — Atif Chaudry
(74) *Attorney, Agent, or Firm* — King & Spalding L.L.P.

(57) ABSTRACT

A delivery unit (4) has a compensating baffle pot (5) provided with a fuel pump (6) arranged therein and a jet sucking pump (8) for conveying a liquid to the baffle pot (5). The jet sucking pump (8) has a propulsion jet nozzle (13) provided with an opening, a mixing pipe (14), a suction opening with a suction line (11) and a deflecting element (16) located downstream of the mixing pipe (14).

9 Claims, 4 Drawing Sheets

FOREIGN PATENT DOCUMENTS

| | | | |
|---|---|---|---|
| DE | 19855433 | A1 | 6/2000 |
| DE | 10237050 | B3 | 4/2004 |
| DE | 10200500264 | | 8/2005 |
| EP | 1378670 | | 1/2004 |
| GB | 221575 | | 9/1924 |
| JP | 7304340 | | 11/1995 |
| WO | 2004018864 | | 3/2004 |
| WO | 2004018864 | A1 | 3/2004 |
| WO | WO 2004018864 | A1 * | 3/2004 |
| WO | 2004111427 | A1 | 12/2004 |

* cited by examiner

DELIVERY UNIT AND JET SUCTION PUMP

CROSS-REFERENCE TO RELATED APPLICATIONS

This application is a U.S. national stage application of International Application No. PCT/EP2006/050154 filed Jan. 11, 2006, which designates the United States of America, and claims priority to German application number 10 2005 014 287.7 filed Mar. 24, 2005, the contents of which are hereby incorporated by reference in their entirety.

TECHNICAL FIELD

The subject of the invention concerns a delivery unit and a jet suction pump.

BACKGROUND

A delivery unit may have a baffle pot, a fuel pump arranged in the baffle pot and a jet suction pump delivering into the baffle pot, the jet suction pump comprising a propulsion jet nozzle with a nozzle opening, a mixing pipe, a suction opening, a suction line connected thereto. The jet suction pump is used to deliver fuel from a fuel container into a baffle pot which is arranged within the fuel container.

It is known that fuel containers have many shapes. With the adaptation of the fuel container to the vehicle, using the available space, fuel containers which are subdivided into a plurality of chambers are produced.

These chambers are for the most part connected to a saddle. In such fuel containers, the problem arises that, when there is a low level, the fuel can no longer get from one chamber over the saddle into the other chamber. Since usually only one delivery unit is arranged in a fuel container, the fuel located in another chamber cannot reach the delivery unit. In these cases, jet suction pumps are used to feed the fuel present in another region of the fuel container to the delivery unit or to deliver the fuel at least into the chamber or the region in which the delivery unit is located.

Conventional jet suction pumps are arranged at the bottom of the chambers or the regions of the fuel container from which the fuel is to be delivered to the delivery unit. With the arrangement of the suction opening of the jet suction pump at the bottom of the fuel container, the jet suction pump is always in the fuel and is thus always ready to operate. Jet suction pumps of this type are distinguished by good efficiency. The delivery factor, that is the ratio of combined jet to propulsion jet, is at least around 7. The disadvantage in this case is that, with the propulsion line to the jet suction pump and the combined line from the jet suction pump, two lines are required, which have to be laid and fixed in the fuel container.

Furthermore, it is known to use sucking jet suction pumps which are arranged in the region of the delivery unit. From the jet suction pump, a suction line leads in the region from which the fuel is to be delivered. In order to produce the necessary negative pressure in the suction line, the jet suction pump has a specific propulsion jet nozzle. The outlet opening of the propulsion jet nozzle is designed as a slot. As a result of the slot, the propulsion jet fans out after emerging from the propulsion jet nozzle. The fanned out propulsion jet closes the mixing tube, by which means the necessary negative pressure is produced in order to be able to suck in the fuel over the relatively long suction line. As a result, only one line instead of two lines as hitherto has to be laid in the fuel container and to be fixed. The disadvantage with this arrangement is the low delivery factor of the sucking jet suction pump, which is approximately 2. This low delivery factor is caused by the propulsion jet fanning out after leaving the propulsion jet nozzle.

Furthermore, a jet suction pump is known which is arranged with the outlet end of the mixing pipe in a pot, so that the delivery medium in the pot seals off the end of the mixing pipe with respect to the atmosphere. By means of this liquid closure, a negative pressure is produced at the entry to the mixing pipe, which contributes to improving the suction performance. However, it has been shown that, under certain conditions, the suction performance is no longer achieved, which allows it to be concluded that the liquid closure of the outlet of the mixing pipe is not always ensured.

This can be caused, for example, by there being too low a quantity of the delivered liquid in the pot.

SUMMARY

A suction jet suction pump having an improved delivery factor, the suction performance being ensured even under unfavorable conditions, and a jet suction pump that is constructed simply and compactly and to be easy to mount can be provided by an embodiment of a jet suction pump comprising a propulsion jet nozzle with a nozzle opening, a mixing pipe, a suction opening, a suction line connected thereto, wherein a baffle element is arranged downstream of the mixing pipe.

According to a further embodiment, the surface of the baffle element facing the mixing pipe may be concave. According to a further embodiment, According to yet a further embodiment, the surface of the baffle element facing the mixing pipe may have ribs. According to a further embodiment, the ribs can be integrally molded in one piece on the baffle element. According to a further embodiment, the baffle element can be connected to the jet suction pump by a latching and plug-in connection. According to a further embodiment, the baffle element can be connected in one piece to the jet suction pump via at least one web. According to a further embodiment, the baffle element can be arranged on another component of the delivery unit, in particular the baffle pot or the fuel pump. According to a further embodiment, the baffle element can be integrally molded in one piece on the delivery unit. According to a further embodiment, the baffle element can be fixed to the delivery unit by means of a latching and plug-in connection.

BRIEF DESCRIPTION OF THE DRAWINGS

The invention will be explained in more detail using a number of exemplary embodiments. Here.

DETAILED DESCRIPTION

According to an embodiment, a baffle element is arranged downstream of the mixing pipe.

By means of the baffle element arranged downstream of the mixing pipe, the delivered medium emerging from the mixing pot at high velocity is split and swirled in the region of the outlet opening of the mixing pipe. This swirling of the medium ensures a permanent and reliable liquid closure of the outlet opening of the mixing pipe, so that an adequate negative pressure can form in the jet suction pump, which permits the medium to be delivered to be sucked in over a great distance.

According to an embodiment, the surface of the baffle element facing the mixing pipe is concave or formed as a pocket. An embodiment of this type can be produced with little effort and is therefore particularly inexpensive.

A shape of the baffle element that can likewise be produced beneficially is given by ribs on the surface of the baffle element facing the mixing pipe. In this case, the ribs can be integrally molded in one piece on the baffle element if the baffle element is produced by means of injection molding.

The costs for the production of the concave surface or the ribs can be reduced if these are arranged in the region of the outlet opening of the mixing pipe.

The baffle element can, moreover, be produced more inexpensively if it is connected to the jet suction pump by means of a latching and plug-in connection. In this case, the connection can be made both to the mixing pipe and to the housing of the jet suction pump.

Mounting of the baffle element with the jet suction pump is avoided, according to another embodiment, if the baffle element is connected in one piece to the jet suction pump. In the simplest case, this connection is formed as at least one web, which extends from the mixing pipe to the baffle element. In this way, baffle element and jet suction pump form one unit. As a result, the jet suction pump can be used at any desired locations.

If the jet suction pump is used for filling the baffle pot, the jet suction pump is able to deliver over the upper edge into the baffle pot, and can be advantageously arranged in the region of the upper edge. In this case, according to a further embodiment, the baffle element can be arranged on another component of the delivery unit, in particular the baffle pot, the fuel pump, filter or pressure regulator.

Here, the baffle element can be arranged on components of the delivery unit by means of a latching and plug-in connection, by means of adhesive bonding or welding or by means of a one-piece formation on a component, for example by spraying on to the baffle pot.

Figure 1:
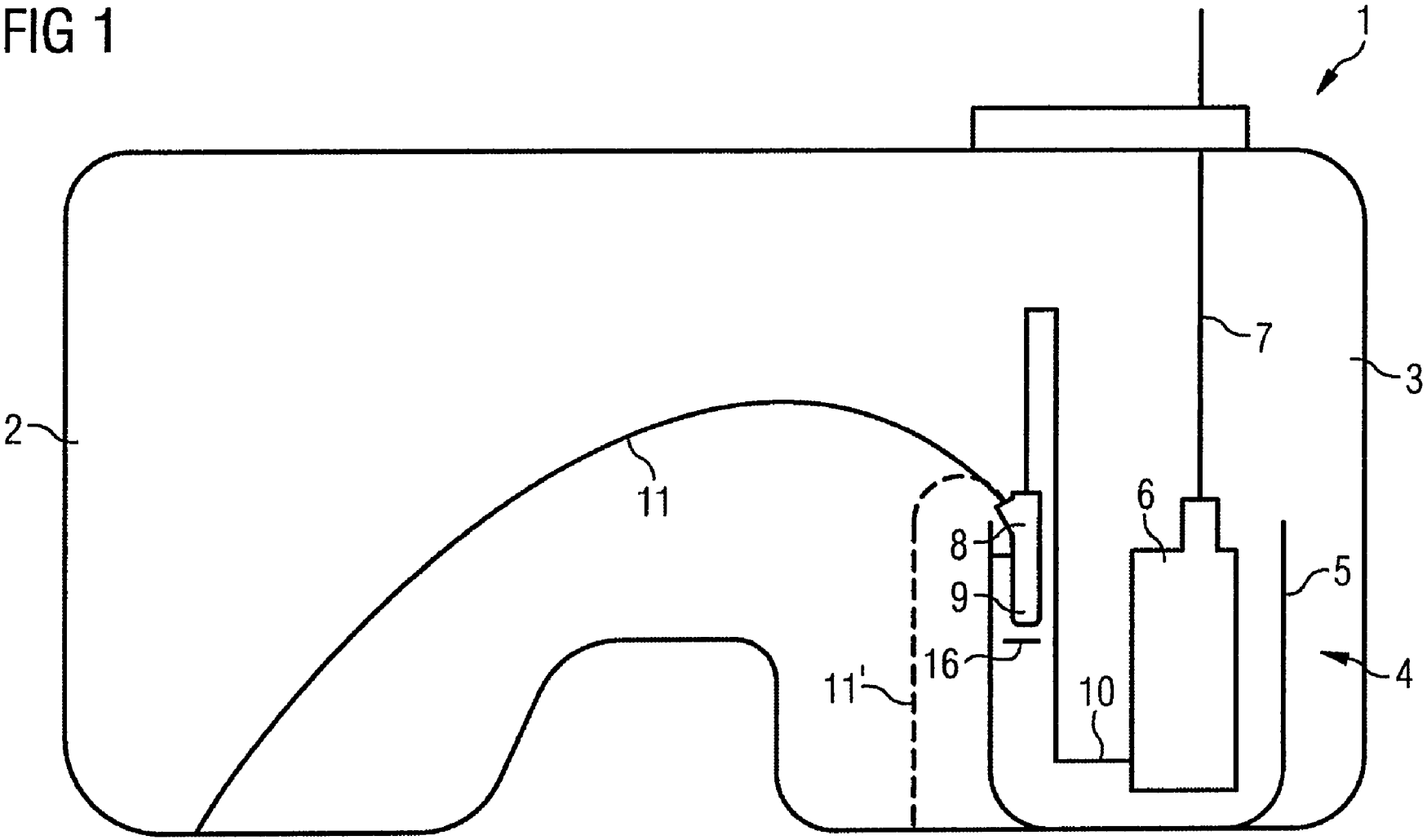
FIG. 1 shows a schematic arrangement of a delivery unit in a fuel container, FIGS. 2*a, b* show the enlarged illustration of the jet suction pump with baffle element according to FIG. 1.

A fuel container 1 comprising two chambers 2, 3 is illustrated in FIG. 1. Fixed in the fuel container 1 is a delivery unit 4, comprising a baffle pot 5 and a fuel pump 6 arranged therein. The fuel delivered by the fuel pump 6 to an internal combustion engine, not illustrated, is led via a flow line 7. Arranged on the inner wall of the baffle pot 5 is a jet suction pump, its mixing pipe 9 projecting into the baffle pot. Fuel from the fuel pump 6 is fed to the jet suction pump 8 via a line 10. A further line 11 extends from the jet suction pump 9 into the other chamber 2. Fuel from the chamber 2 is delivered directly into the baffle pot 5 via the line 11. Downstream of the jet suction pump 8 there is arranged a baffle element 12.

Figure 2A:
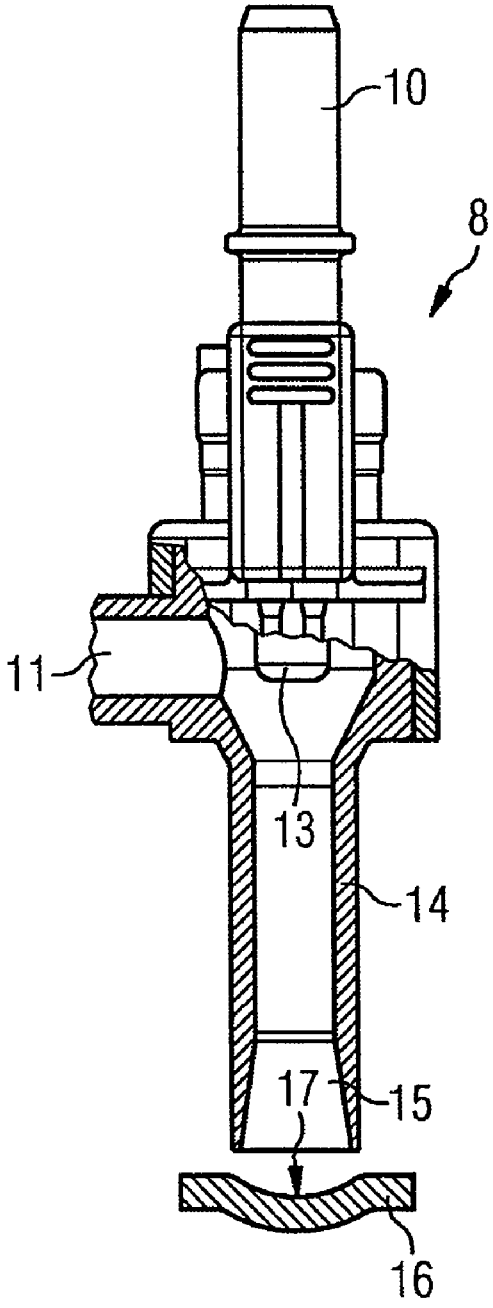

The jet suction pump 8 illustrated in FIG. 2*a* comprises a propulsion jet nozzle 13, a mixing pipe 14 having an outlet opening 15 and the suction line 11. In the region of the outlet opening 15 there is arranged a baffle element 16. Its surface 17 facing the outlet opening 15 is concave, so that the jet emerging from the mixing pipe 14 is swirled by the concave surface 17 and leads to a liquid closure of the mixing pipe 14. As a result of the liquid closure, a sufficient negative pressure can be built up in the jet suction pump 8, by means of which fuel is delivered from the fuel container via the suction line 11.

Figure 2B:
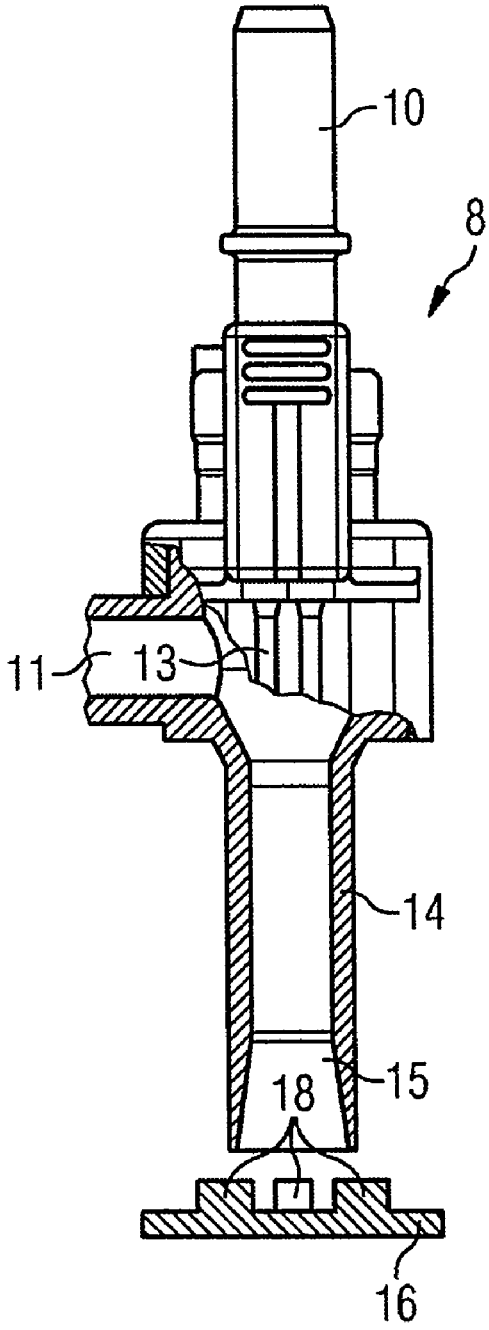

The jet suction pump 8 illustrated in FIG. 2*b* differs from the pump according to FIG. 2*a* in the baffle element 16. Ribs 18 are integrally molded in one piece on the baffle element 16, with which ribs the same effect is produced as with the concave surface.

Figure 3:
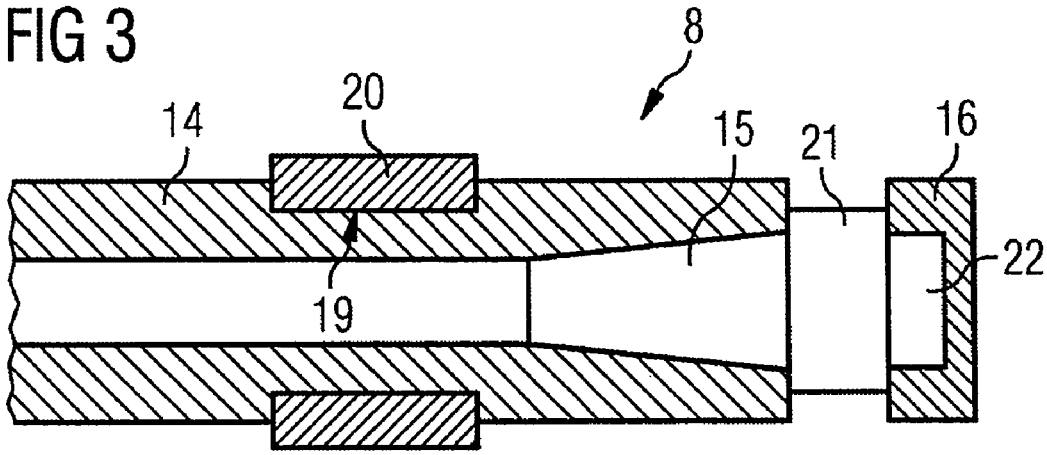
FIG. 3 shows a sectional illustration through a mixing pipe of a jet suction pump with baffle element.

According to FIG. 3, the mixing pipe 14 of the jet suction pump 8 is provided with an external circumferential groove 19. Arranged in this groove 19 is a clip 20, which merges into a web 21. The baffle element 16 is integrally molded in one piece on the web 21 with a pocket 22. This clip 20 having the baffle element 16 is produced particularly inexpensively as a simply constructed molding by means of injection molding.

Figure 4:
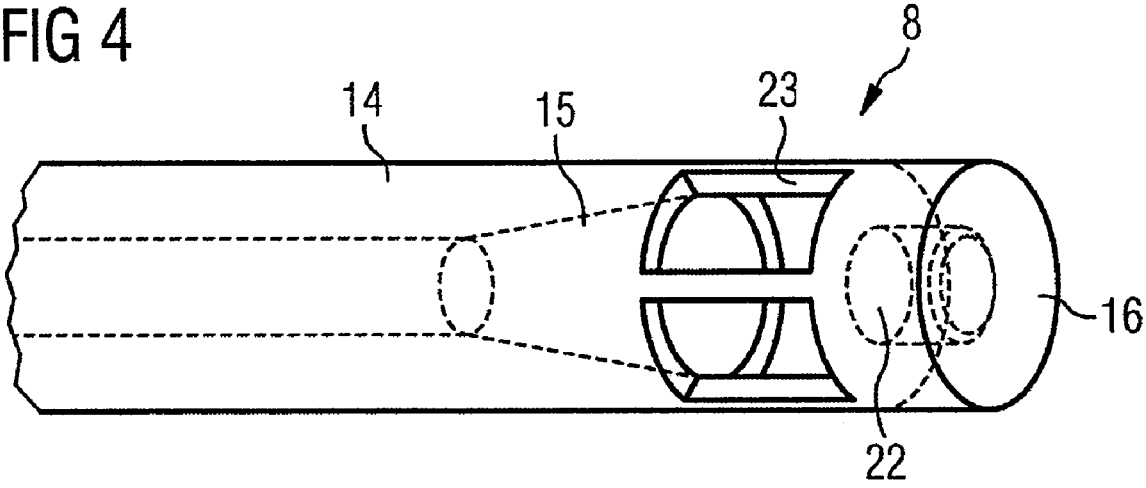
FIG. 4 shows a perspective view of a mixing pipe with baffle element.

According to FIG. 4, the baffle element 16 is fabricated in one piece with the jet suction pump 8, by being connected to the outlet opening 15 of the mixing pipe 14 via webs 23.

Figure 5:
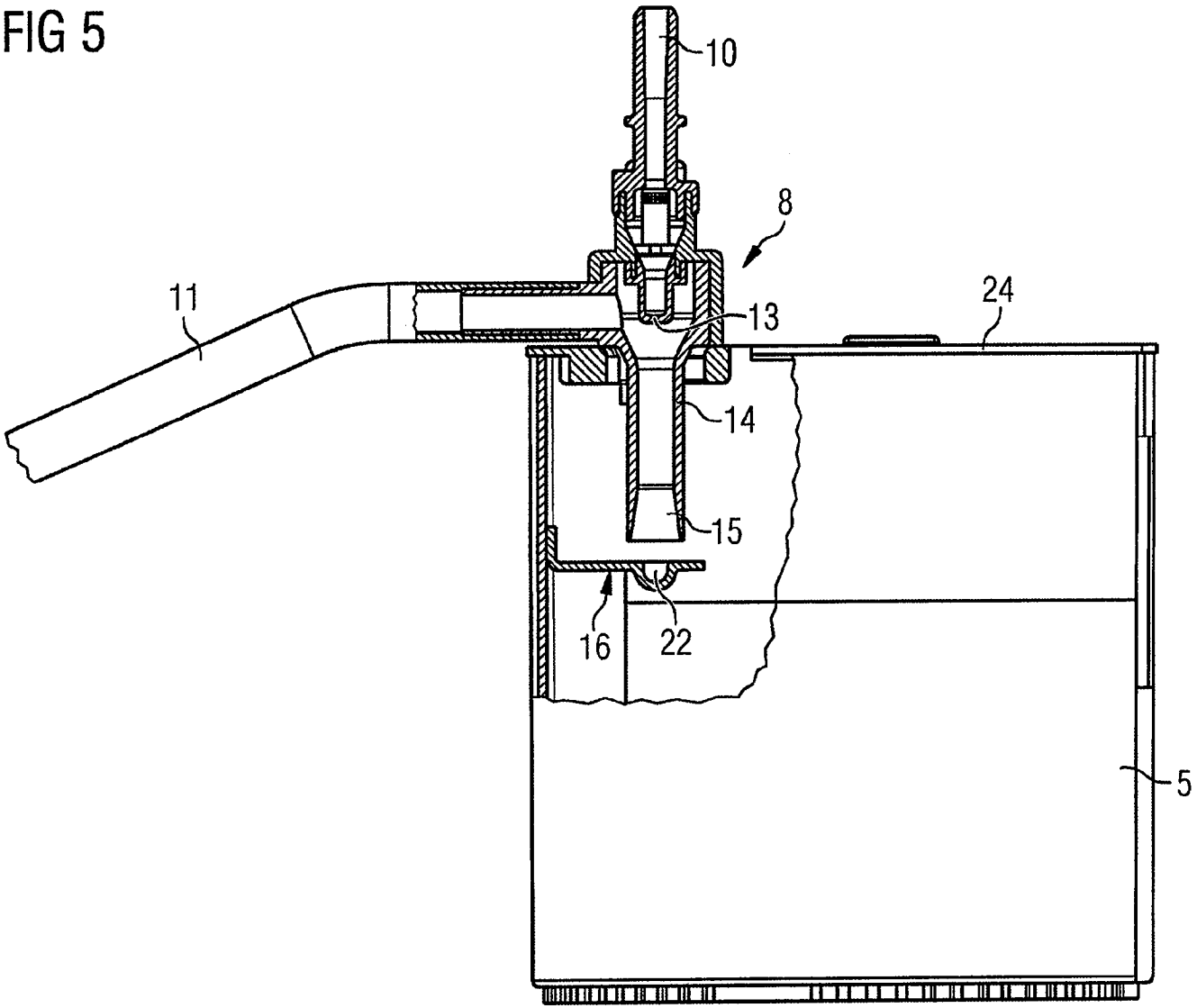
FIG. 5 shows the baffle pot of a delivery unit with a baffle element.

FIG. 5 shows a further embodiment of the delivery unit, in which the jet suction pump 8 is fixed to a cover 24 of the baffle pot 5. By means of the propulsion jet line 10, a propulsion jet is fed to the jet suction pump 8 from the fuel pump, not illustrated. A nonreturn valve in the propulsion jet line seals off the latter with respect to running empty. In the region of the propulsion jet nozzle 13, the suction line 11 opens into the jet suction pump 8. The propulsion jet emerges through the propulsion jet nozzle 13 and enters the mixing pipe 14. After leaving the mixing pipe 15, the jet strikes the pocket 22, by which means the jet is swirled and seals off the outlet opening 15. The pocket 22 is part of the baffle element 16, which is welded onto the inner wall of the baffle pot 5. The baffle element 16 can, however, also be clipped to the baffle pot 5, in particular hooked onto the upper edge of the baffle pot 5 or arranged on the cover 24. On account of the liquid closure of the mixing pipe 14 brought about by the baffle element, the propulsion jet produces a substantially higher negative pressure, which is in turn is sufficient to deliver a relatively large quantity of fuel into the baffle pot 5 over a relatively great distance by means of the suction line 11.

What is claimed is:

1. A delivery unit comprising a baffle pot, oh/r| pump arranged in the baffle pot and a jet suction pump delivering into the baffle pot, the jet suction pump comprising:

a propulsion jet nozzle with a nozzle opening, a mixing pipe having an outlet, a suction opening, a suction line connected thereto, wherein a baffle element is arranged downstream of the mixing pipe and inside the baffle pot, wherein the baffle element is spaced apart from the mixing pipe and connected to the mixing pipe by a plurality of connecting members, wherein the plurality of connecting members are spaced apart to form openings such that fuel can flow from the mixing pipe, through the openings between the connecting members, and into the baffle pot, and wherein the openings are located between the outlet of the mixing pipe and the baffle element, wherein the baffle element includes a pocket centrally aligned with a central longitudinal axis of the mixing pipe and extending away from the mixing pipe, the pocket of the baffle element having a shape and size configured to cause a jet of fuel propelled through the outlet of the mixing pipe and into the pocket to become swirled and thereby seal off the outlet of the mixing pipe; and wherein an outer perimeter of the mixing pipe, an outer perimeter of the connecting members, and an outer perimeter of the baffle member are the same, such that the mixing pipe, the connecting members, and the baffle member form an integral cylindrical body.

2. The delivery unit according to claim 1, wherein the baffle element is connected in one piece to the jet suction pump via the connecting members, which include at least one web.

3. The delivery unit according to claim 1, wherein the mixing pipe, baffle element, and connection members define a single integral piece.

4. A jet suction pump comprising:

a propulsion jet nozzle with a nozzle opening, a mixing pipe having a body extending in a longitudinal direction and terminating in an outlet, a suction opening, and a suction line connected thereto, wherein a baffle element is arranged downstream of the mixing pipe and inside a baffle pot, wherein the baffle element is spaced apart from the mixing pipe and connected to the mixing pipe by a plurality of connecting members, each connecting member directly connecting an axial end of the mixing pipe outlet with the baffle element, such that the mixing pipe body, the mixing pipe outlet, the connecting members, and the baffle element together form a continuous structure extending continuously in the longitudinal direction, wherein the plurality of connecting members are spaced apart to form openings such that fuel can flow from the mixing pipe, through the openings between the connecting members, and into the baffle pot, wherein the openings are located between the outlet of the mixing pipe and the baffle element; and wherein an outer perimeter of the mixing pipe, an outer perimeter of the connecting members, and an outer perimeter of the baffle member are the same, such that the mixing pipe, the connecting members, and the baffle member form an integral cylindrical body.

5. The jet suction pump according to claim 4, wherein the surface of the baffle element facing the mixing pipe comprises a pocket.

6. The jet suction pump according to claim 4, wherein the baffle element is connected in one piece to the jet suction pump via the connecting members, which include at least one web.

7. The jet suction pump according to claim 4, wherein the mixing pipe, baffle element, and connection members define a single integral piece.

8. A delivery unit comprising a baffle pot, a fuel pump arranged in the baffle pot and a jet suction pump delivering into the baffle pot, the jet suction pump comprising a propulsion jet nozzle with a nozzle opening, a mixing pipe having an outlet, a suction opening, and a suction line connected thereto, wherein a baffle element is arranged downstream of the mixing pipe on the baffle pot or the fuel pump, such that the baffle element is spaced apart from the mixing pipe and connected to the mixing pipe by a plurality of connecting members formed integrally with the mixing pipe and baffle element, wherein the plurality of connecting members are spaced apart to form openings such that fuel can flow from the mixing pipe, through the openings between the connecting members, and into the baffle pot, wherein the openings are located between the outlet of the mixing pipe and the baffle element, wherein the mixing pipe, baffle element, and connection members are defined by a single integral piece, the integrated mixing pipe, baffle element, and connection members being free of any structure formed radially inside of, and spaced apart from, another structure, such that the mixing pipe, baffle element, and connection members can be formed according to particular fabrication processes; and wherein an outer perimeter of the mixing pipe, an outer perimeter of the connecting members, and an outer perimeter of the baffle member are the same, such that the mixing pipe, the connecting members, and the baffle member form an integral cylindrical body.

9. The delivery unit according to claim 8, wherein the surface of the baffle element facing the mixing pipe comprises a pocket.

* * * * *